US007467532B2

(12) United States Patent
Golovashchenko

(10) Patent No.: US 7,467,532 B2
(45) Date of Patent: Dec. 23, 2008

(54) APPARATUS FOR ELECTROMAGNETICALLY FORMING A WORKPIECE

(75) Inventor: Sergey Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 575 days.

(21) Appl. No.: 11/163,411

(22) Filed: Oct. 18, 2005

(65) Prior Publication Data

US 2007/0084261 A1 Apr. 19, 2007

(51) Int. Cl.
*H01F 41/06* (2006.01)
*H01F 27/28* (2006.01)
*B21D 26/02* (2006.01)

(52) U.S. Cl. ..... 72/56; 72/430; 72/705; 29/419.2

(58) Field of Classification Search ..... 72/55, 72/56, 430, 705, 707; 29/419.2
See application file for complete search history.

(56) References Cited

U.S. PATENT DOCUMENTS

| | | | | |
|---|---|---|---|---|
| 2,876,324 | A | 3/1959 | Longacre | |
| 3,372,566 | A | 3/1968 | Schenk et al. | |
| 3,486,356 | A | 12/1969 | Brower et al. | |
| 3,550,416 | A | 12/1970 | Schenk et al. | |
| 3,654,787 | A | 4/1972 | Brower | |
| 3,888,098 | A * | 6/1975 | Larrimer et al. | 72/56 |
| 4,127,933 | A * | 12/1978 | Hansen et al. | 29/605 |
| 4,129,846 | A | 12/1978 | Yablochnikov | |
| 4,169,364 | A * | 10/1979 | Khimenko et al. | 72/56 |
| 4,506,132 | A | 3/1985 | Keller | |
| 4,531,393 | A | 7/1985 | Weir | |
| 5,442,846 | A | 8/1995 | Snaper | |
| 5,586,460 | A * | 12/1996 | Steingroever | 72/56 |
| 5,966,813 | A | 10/1999 | Durand | |
| 5,981,921 | A | 11/1999 | Yablochnikov | |
| 6,047,582 | A | 4/2000 | Daehn et al. | |
| 6,050,120 | A | 4/2000 | Daehn et al. | |
| 6,050,121 | A | 4/2000 | Daehn et al. | |
| 6,085,562 | A | 7/2000 | Daehn et al. | |
| 6,104,012 | A | 8/2000 | Durand | |
| 6,128,935 | A | 10/2000 | Daehn et al. | |
| 6,713,735 | B2 | 3/2004 | Terano | |
| 6,765,181 | B1 | 7/2004 | Chatterjee et al. | |
| 6,875,964 | B2 | 4/2005 | Golovashchenko et al. | |

(Continued)

FOREIGN PATENT DOCUMENTS

EP 0 396 848 A2 11/1990

(Continued)

OTHER PUBLICATIONS

U.S. Appl. No. 10/967,978, filed Oct. 19, 2004, Golovashchenko.

(Continued)

*Primary Examiner*—David B Jones
(74) *Attorney, Agent, or Firm*—Raymond L. Coppiellie; Brooks Kushman P.C.

(57) ABSTRACT

An apparatus for electromagnetically forming a workpiece. The apparatus includes a solenoid coil for generating an electromagnetic force and a tool for concentrating electromagnetic force against the workpiece. The tool includes an electrically conductive body having an aperture and an insulator disposed in the aperture.

21 Claims, 3 Drawing Sheets

U.S. PATENT DOCUMENTS

| | | | | |
|---|---|---|---|---|
| 6,954,127 | B2 * | 10/2005 | Berg et al. | 72/56 |
| 2004/0232139 | A1 | 11/2004 | Bass | |

FOREIGN PATENT DOCUMENTS

| | | |
|---|---|---|
| GB | 1 207 917 | 10/1970 |
| JP | 02-117723 | 5/1990 |

OTHER PUBLICATIONS

*Aluminum 2003*, "Proceedings of the TMS 2003 Annual Meeting: Automotive Alloys 2003, Increasing Energy Efficiency in Aluminum, and Universities Servicing Education, Research and Technology Internationally for the Aluminum and Light Metals Industries Symposia," San Diego, California 2003, Subodh K. Das, Editor.

"The Effect of Tool-Sheet Interaction on Damage Evolution in Electromagnetic Forming of Aluminum Alloy Sheet," J.M. Imbert, S.L. Winkler, M.J. Worswick, D.A. Oliveira, and S. Golovashchenko, *Journal of Engineering Materials and Technology*, Copyright © 2005 by ASME.

*Sheet Metal Forming Technology*, Proceedings of a symposium sponsored by the Shaping and Forming Committee, Materials Processing and Manufacturing Division, The Minerals, Metals & Materials Society (TMS), held at the TMS Annual Meeting in San Diego, California, Feb. 28-Mar. 4, 1999, Edited by Mahmoud Y. Demeri.

*Electromagnetic Metal Forming Handbook*, untranslated copy and a translation by I.V. Belyy, S.M. Fertik, and L.T. Khimenko, Translated by M.M. Altynova, Materials Science and Engineering Department, The Ohio State University.

* cited by examiner

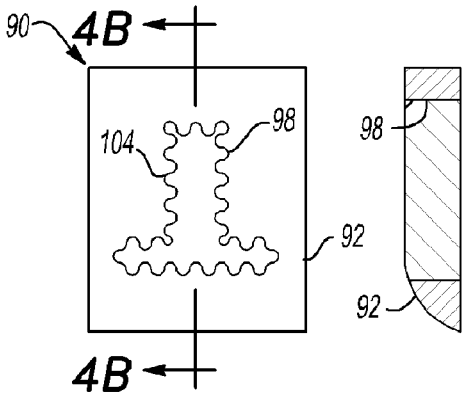
Fig-4A
Fig-4B
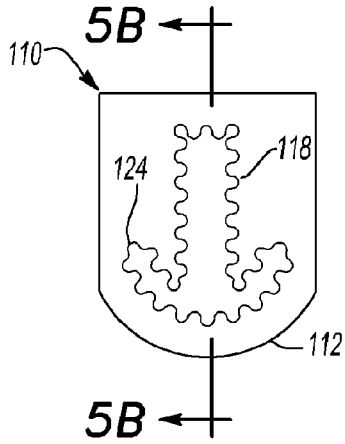
Fig-5A
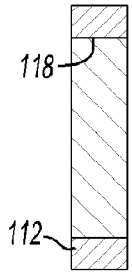
Fig-5B
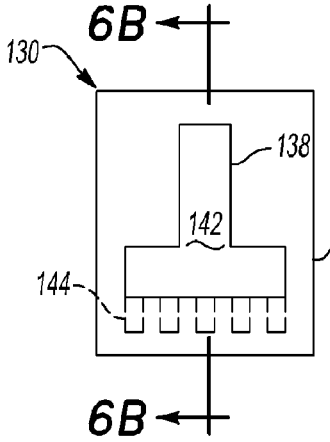
Fig-6A
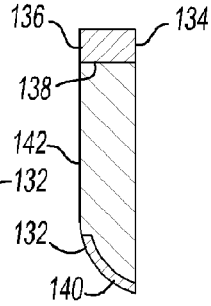
Fig-6B
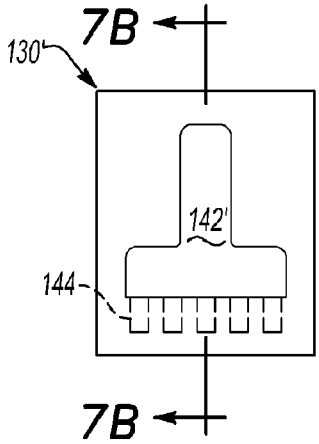
Fig-7A
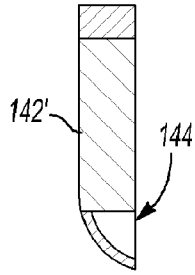
Fig-7B
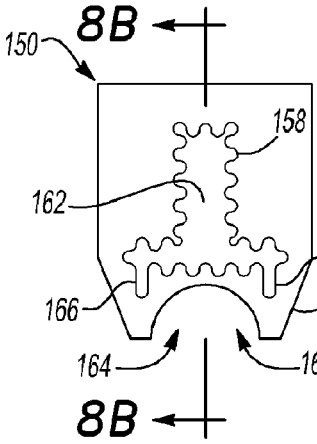
Fig-8A
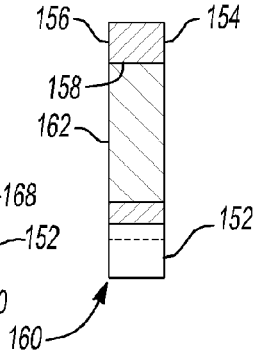
Fig-8B
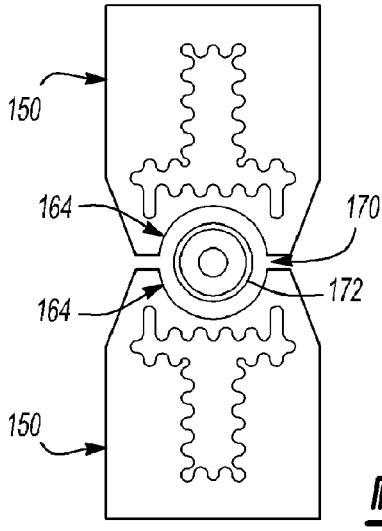
Fig-9

APPARATUS FOR ELECTROMAGNETICALLY FORMING A WORKPIECE

BACKGROUND OF THE INVENTION

1. Field of the Invention

The present invention relates to an apparatus for electromagnetically forming a workpiece.

2. Background Art

Electromagnetic forming is a manufacturing technique used to form a workpiece, such as a metal sheet. In electromagnetic forming, a pulsed electromagnetic field exerts force or pressure against the workpiece. More specifically, a strong electromagnetic field is generated that induces eddy currents in the workpiece. The electromagnetic field interacts with the induced eddy currents and repels the workpiece against a forming surface, thereby providing the workpiece with a desired shape.

Quality problems, such as material failure and material warpage were associated with previous forming devices. Material failure, such as tearing, may occur during forming operations, such as deep drawing. Material warpage may occur when a multi-turn coil is used to provide the electromagnetic field for forming a part. These problems, as well as other problems presented below, may be addressed by one or more embodiments of the present invention as discussed in more detail below.

SUMMARY OF THE INVENTION

In at least one embodiment of the present invention, an apparatus for electromagnetically forming a workpiece is provided. The apparatus includes a solenoid coil for generating an electromagnetic field and a tool for concentrating the electromagnetic field to exert pressure against the workpiece. The tool has an electrically conductive body and an insulator. The electrically conductive body has a first surface, a second surface, and an aperture extending between the first and second surfaces. The insulator is disposed in the aperture and directs current around the aperture to distribute the pressure for forming the workpiece.

In at least one other embodiment, an apparatus for electromagnetically forming a workpiece is provided. The apparatus includes a solenoid coil for generating an electromagnetic field and a tool for concentrating the electromagnetic field provided by the solenoid coil to exert force against the workpiece. The tool includes an electrically conductive body and an insulator. The electrically conductive body has a first surface, a second surface disposed opposite the first surface, an aperture extending between the first and second surfaces, and an end surface for applying electromagnetic force to the workpiece. The insulator is disposed in the aperture. The aperture and the insulator cooperate to increase a current flow path through the electrically conductive body to facilitate electromagnetic forming of the workpiece.

In at least one other embodiment of the present invention, an apparatus for electromagnetically forming a workpiece is provided. The apparatus includes a multi-turn solenoid coil for generating an electromagnetic force and a tool disposed proximate the multi-turn solenoid coil for concentrating electromagnetic force against the workpiece. The tool includes an electrically conductive body and an insulator. The electrically conductive body has a first surface, a second surface, an aperture extending between the first and second surfaces, and an end portion. The end portion is disposed adjacent to the aperture and has at least one recess. The recess is disposed adjacent to the aperture and extends partially through the electrically conductive body. The insulator is disposed in the aperture and directs current around the aperture. The aperture and the recess cooperate to increase a current flow path through the electrically conductive body to facilitate electromagnetic forming of the workpiece and to improve workpiece quality.

BRIEF DESCRIPTION OF THE DRAWINGS

FIGS. 2-9 are various tool embodiments that may be provided with the apparatus for electromagnetically forming a workpiece.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
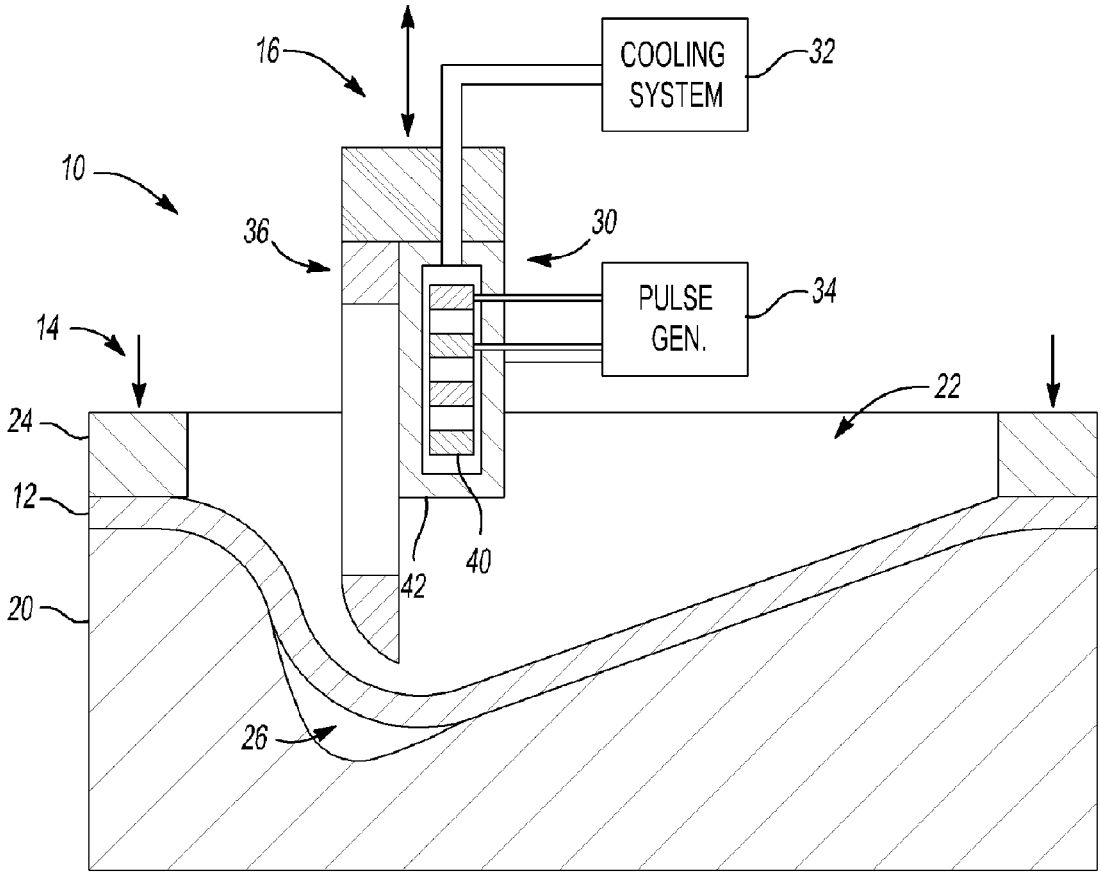
FIG. 1 is a side section view of a system having an apparatus for electromagnetically forming a workpiece.

Referring to FIG. 1, a system 10 for electromagnetically forming a workpiece 12 is shown. The workpiece 12 may have any suitable configuration. For example, the workpiece 12 may be provided as a sheet and may be made of any suitable material, such as a metal like aluminum, steel, or combinations or alloys thereof.

The system 10 may include a die assembly 14 and a forming apparatus 16.

The die assembly 14 may have any suitable configuration. In the embodiment shown in FIG. 1, the die assembly 14 includes a forming die 20 having a cavity 22 that is configured to provide a desired shape for the workpiece 12.

The die assembly 14 may also include a second portion or ram 24 that may be configured to hold at least a portion of the workpiece 12 against the forming die 20. The ram 24 and/or forming die 20 may be movable relative to each other. For instance, the ram 24 may be configured to move between a retracted position in which the ram 24 is spaced apart from the workpiece 12 and an advanced position in which the ram 24 exerts force against the workpiece 12 to hold the workpiece 12 against the forming die 20 as shown in FIG. 1.

The die assembly 14 may facilitate any suitable workpiece forming or shaping operation. For instance, the die assembly 14 may facilitate electromagnetic forming as well as non-electromagnetic forming operations like drawing, restriking, flanging, and/or piercing. For clarity, many features associated with such non-electromagnetic forming operations are omitted from FIG. 1.

In at least one embodiment, the workpiece 12 may be partially formed prior to electromagnetic forming. For example, the workpiece 12, which may be initially provided as a generally planar sheet, may be partially formed against the forming die 20 such that a gap 26 is disposed between a portion of the workpiece 12 and the forming die 20. The gap 26 may be provided in one or more locations where an initial forming operation may not adequately provide the workpiece 12 with a desired level of quality. Electromagnetic forming may be employed to fill the die cavity in these areas, which may be otherwise difficult to fill.

The forming apparatus 16 may facilitate electromagnetic forming of the workpiece 12. The forming apparatus 16 may have any suitable configuration and may include a coil assembly 30, a cooling system 32, an electromagnetic pulse generator 34, and a concentrator or forming tool 36. In addition, the forming apparatus 16 may be moveable relative to the die assembly 14 as denoted by the double arrow line in FIG. 1.

The coil assembly 30 may have any suitable configuration. In the embodiment shown in FIG. 1, the coil assembly 30 includes a solenoid coil 40 disposed in a housing 42. An exemplary coil assembly is described in U.S. Patent Publication No. 2006/0086165 A1filed Oct.10, 2004, which is assigned to assignee of the present invention and is hereby incorporated by reference in its entirety.

The solenoid coil 40 may be configured as a single turn or a multi-turn coil made of an electrically conductive material, such as steel or bronze. The solenoid coil 40 may be disposed in the housing 42 and may include one or more insulating members (not shown) disposed between the coil 40 and the housing 42 and/or between one or more turns of the coil 40. In the embodiment shown in FIG. 1, a flat multi-turn solenoid coil 40 is provided in which the turns of the coil 40 are spaced apart from each other to prevent short circuiting. Optionally, one or more non-conductive reinforcement members (not shown) may be disposed adjacent to or inserted through the turns of the coil 40 and/or insulating members to inhibit expansion of the coil 40 during operation. The solenoid coil 40 may be provided as a flat coil to provide durability and high efficiency for high volume manufacturing operations, such as the fabrication of automotive parts.

The cooling system 32 may provide a fluid, such as a gaseous or liquid coolant, for cooling the coil 40 to diminish thermal loads and improve operating performance.

The electromagnetic pulse generator 34 may be electrically coupled to the coil 40 and may have any suitable configuration. For instance, the electromagnetic pulse generator 34 may include one or more voltage sources, such as one or more capacitors, that may be discharged to provide current flow through the coil 40, thereby generating a strong electromagnetic field.

The forming tool 36 may be disposed proximate the coil assembly 30 and may concentrate electromagnetic force against the workpiece 12. The forming tool 36 may be provided in various embodiments as shown in FIGS. 1-9. In each of these embodiments, the forming tool includes an electrically conductive body made of an electrically conductive material, such as a metal like steel, aluminum, brass, copper, or combinations or alloys thereof. The electrically conductive body includes an aperture. An insulator, such as vacuum, air, or a generally non-electrically conductive material like Micarta® may be provided in the aperture for inhibiting current flow therein. As such, the aperture and/or insulator cooperate to direct current flow around the aperture, thereby increasing the current flow path as compared to a forming tool that does not include an aperture. The increased current flow path may help improve the quality of an electromagnetically formed portion of the workpiece 12 by improving electromagnetic force distribution and/or inhibiting material failure or warpage.

In FIGS. 2-9, electrical connections between the forming tool and the electromagnetic pulse generator are omitted for clarity. In each of these embodiments, current may flow through the forming tool in any suitable direction, such as in a clockwise or counterclockwise direction around the aperture.

Figures 2A, 2B, 3A, 3B:
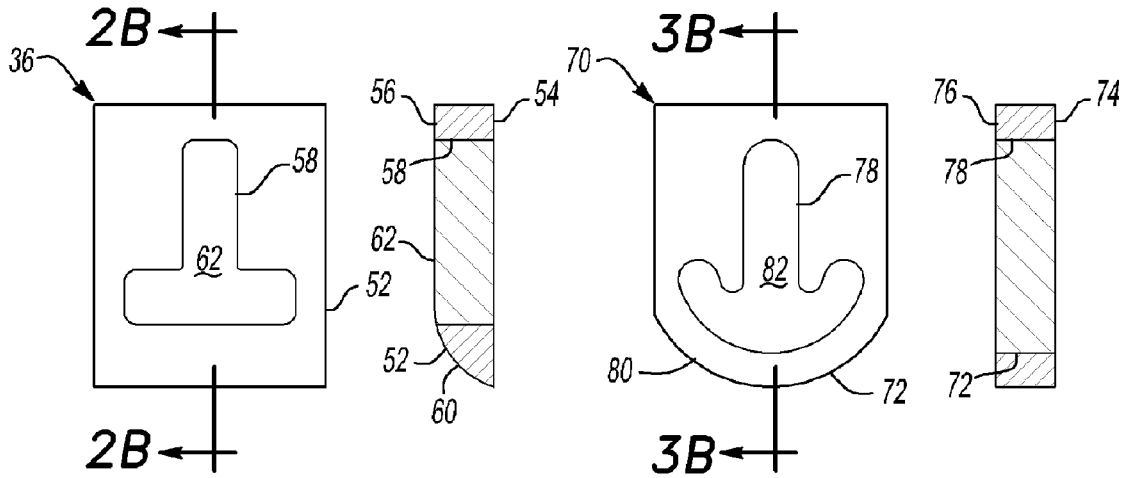

Referring to FIGS. 1, 2*a* and 2*b*, a first embodiment of the forming tool 36 is shown. In the embodiment shown, the forming tool 36 includes an electrically conductive body 52 having a first surface 54, a second surface 56 disposed opposite the first surface 54, an aperture 58 extending between the first and second surfaces 54, 56, and an end surface 60 for applying or concentrating electromagnetic force toward the workpiece. The aperture 58 is shown having a generally inverted T-shape in which the top of the "T" is oriented toward the end surface 60. The T-shape helps increase the current flow path through the electrically conductive body 52. An insulator 62 may be disposed in the aperture 58 and may help improve the strength and durability of the forming tool 36.

Referring to FIGS. 3*a* and 3*b*, a second embodiment of the forming tool 70 is shown. In this embodiment, the forming tool 70 includes an electrically conductive body 72 having a first surface 74, a second surface 76 disposed opposite the first surface 74, an aperture 78 extending between the first and second surfaces 74, 76, and a curved end surface 80. The aperture 78 is shown having a generally inverted T-shape in which the top of the "T" is oriented toward the curved end surface 80 and curved in generally the same manner as the curved end surface 80. An insulator 82 may be disposed in the aperture 78 and may help improve tool strength and durability as previously described.

Referring to FIGS. 4*a* and 4*b*, a third embodiment of the forming tool 90 is shown. In this embodiment, the electrically conductive body 92 has a generally T-shaped aperture 98 as previously described with respect to FIGS. 2*a* and 2*b*. In addition, the aperture 98 is defined by a wavy or serpentine wall 104 that includes a plurality of curved surfaces. The serpentine wall 104 may increase the current flow path through the body 92 and its working surface that faces the workpiece 12 to a greater amount than a generally linear wall to help improve electromagnetic forming quality and efficiency. The serpentine wall 104 may be provided around the entire aperture 98 or a portion thereof in various embodiments of the present invention.

Referring to FIGS. 5*a* and 5*b*, a fourth embodiment of the forming tool 110 is shown. This embodiment is similar to the embodiment shown in FIGS. 3*a* and 3*b*. The forming tool 110 includes an electrically conductive body 112 having a curved, generally T-shaped aperture 118. At least a portion of the aperture 118 is defined by a wavy or serpentine wall 124 that may help increase the current flow path and improve workpiece quality as previously described.

Referring to FIGS. 6*a* and 6*b*, a fifth embodiment of the forming tool 130 is shown. This embodiment is similar to that shown in FIGS. 2*a* and 2*b* and includes an electrically conductive body 132 having a first surface 134, a second surface 136 disposed opposite the first surface 134, a generally T-shaped aperture 138 extending between the first and second surfaces 134, 136, and an end surface 140. An insulator 142 is disposed in and generally fills the aperture 138. In addition, the forming tool 130 may include one or more recesses 144 that extend from the aperture 138 toward the end surface 140. The one or more recesses 144 may extend from the first surface 134 toward the second surface 136. In addition, the insulator 142 may at least partially fill one or more recesses 144 as is best shown in FIG. 6*b* to help improve the strength and durability of the forming tool 130. Alternatively, one or more recesses 144 may not be filled or partially filled with the insulator 142' as depicted in a sixth embodiment of the forming tool 130' shown in FIGS. 7*a* and 7*b*.

Referring to FIGS. 8*a* and 8*b*, a seventh embodiment of the forming tool 150 is shown. In this embodiment, the forming tool 150 includes a body 152 having a first surface 154, a second surface 156, an aperture 158 having a serpentine aperture wall, and an end surface 160. An insulator 162 is disposed in the aperture 158 as previously described. In addition, a cavity 164 is provided along the end surface 160 that extends toward the aperture 158. The cavity 164 may have any suitable configuration, such as the generally semi-circular configuration shown in FIG. 8*a*. First and second extension portions 166, 168, may extend from the aperture 158 toward the end surface 160 along opposite sides of the cavity 164 to help further increase the current flow path. The first and second extension portions 166, 168 may be spaced apart from the end surface 160 and from the cavity 164. In addition, the insulator 162 may fill or partially fill the extension portions 166, 168 in various embodiments of the present invention.

Referring to FIG. 9, two forming tools 150 as described with respect to FIGS. 8*a* and 8*b* are shown. The forming tools 150 are disposed opposite and spaced apart from each other such that the cavities 164 of each tool 150 cooperate to define a generally circular chamber 170. A workpiece 172 may be disposed in the chamber 170 and may be electromagnetically formed against a core 172 when electromagnetic force is provided by each tool 150.

Figure 10:
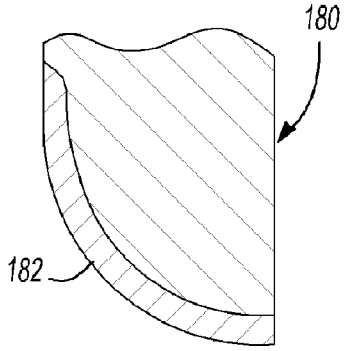
FIGS. 10 and 11 are embodiments of tool end portions that may be provided with the tool embodiments shown in FIGS. 2-9.
Figure 11:
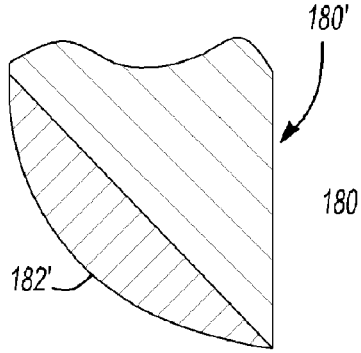

Referring to FIGS. 10 and 11, magnified views of two multi-material forming tools are shown. In FIGS. 10 and 11, the end or working surface of the forming tool 180, 180' has an end feature 182, 182' that may be made of a material having higher conductivity than an adjacent portion of the forming tool 180, 180' to help improve the distribution of electromagnetic force. In FIG. 10, the end feature 182 is provided as a layer having a generally uniform thickness. In FIG. 11 the end feature 182' is provided with a non-uniform thickness. The end features 182, 182' may be made of any suitable material, such as copper, aluminum, low carbon steel, or brass. In addition, the end features 182, 182' may be provided in any suitable manner, such as with any suitable surface coating process (e.g., spraying, plating, electrostatic coating, etc.) or as a separately manufactured component that may be attached in any suitable manner. These multi-material embodiments may be provided with any of the forming tool embodiments of the present invention.

Figure 12:
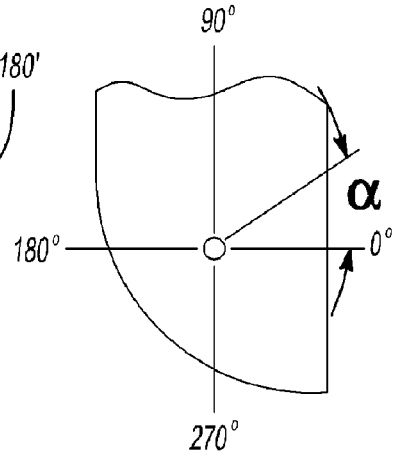
FIG. 12 is a graphical depiction of a portion of a forming tool.
Figure 13:
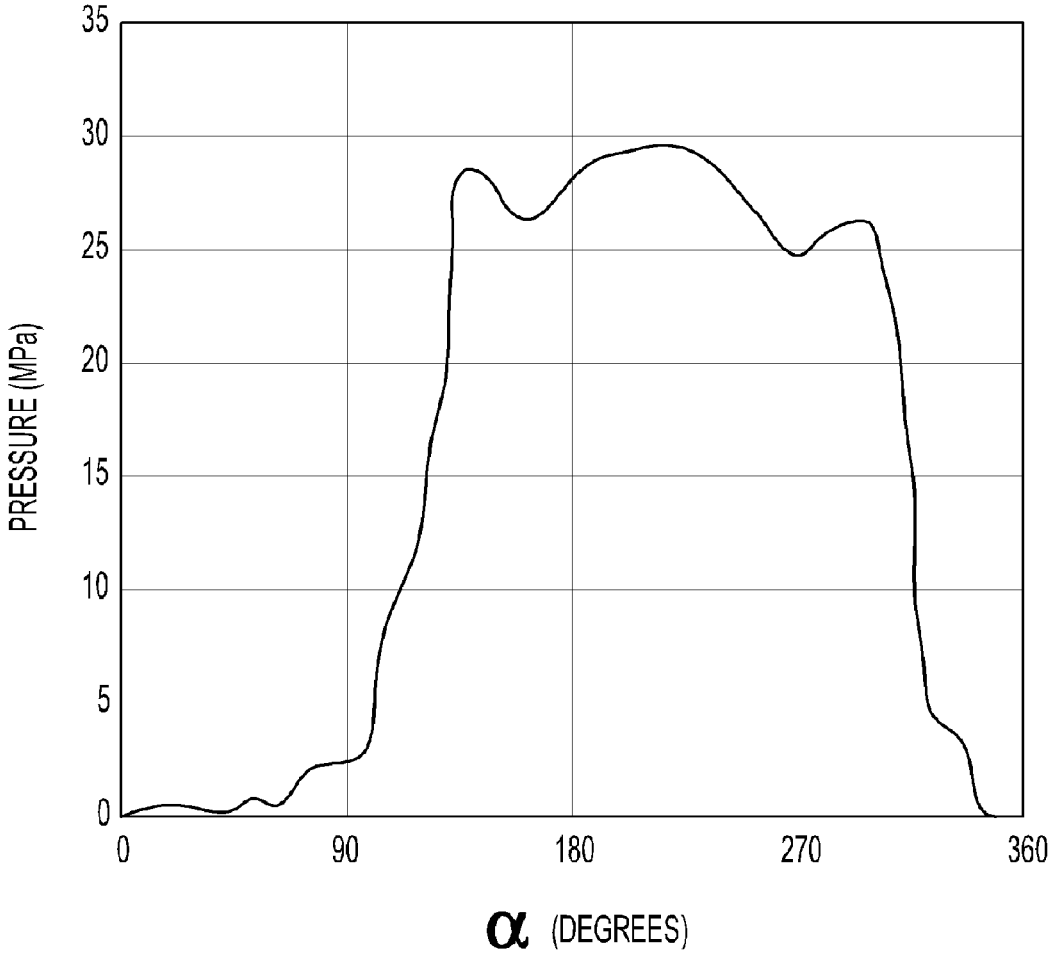
FIG. 13 is a plot of the distribution of electromagnetic pressure on the workpiece in accordance with one embodiment of the present invention.

Referring to FIGS. 12 and 13, a graphical depiction of the distribution of electromagnetic force against the workpiece is shown.

In FIG. 12, a cross section of an end region of an exemplary forming tool is shown. An angle, designated alpha ($\alpha$), is measured in degrees in a counterclockwise direction relative to a generally horizontal line extending to the right of a vertex point.

In FIG. 13, angle alpha ($\alpha$) is plotted on the horizontal axis while the distribution of electromagnetic pressure is shown along a vertical axis. This plot shows that the electromagnetic pressure is elevated and within the range of approximately 25-30 MPa from approximately 150° to 300°. This angular region generally corresponds with the curved surface of the forming tool shown in the top portion of FIG. 12 that concentrates electromagnetic force against the workpiece. As such, the plot shows that the present invention helps provide a generally uniform distribution of electromagnetic pressure along the force concentrating surface of the forming tool, which helps inhibit workpiece warping and other surface defects.

While the best mode for carrying out the invention has been described in detail, those familiar with the art to which this invention relates will recognize various alternative designs and embodiments for practicing the invention as defined by the following claims.

What is claimed is:

1. An apparatus for electromagnetically forming a workpiece, the apparatus comprising:

a solenoid coil for generating an electromagnetic field; and a tool for concentrating the electromagnetic field to exert pressure against the workpiece, the tool including:

an electrically conductive body having a first surface, a second surface, and an aperture having a generally T-shaped configuration extending between the first and second surfaces; and an insulator disposed in the aperture, the insulator directing current around the aperture to distribute the pressure for forming the workpiece.

2. The apparatus of claim 1 wherein the insulator is air.

3. The apparatus of claim 1 wherein the insulator is an electrically nonconductive material that fills the aperture to structurally reinforce the tool.

4. The apparatus of claim 1 wherein the aperture includes an aperture wall extending between the first and second surfaces, the aperture wall having a serpentine configuration that increases a current flow path through the electrically conductive body and toward a working surface disposed proximate an end of the tool facing the workpiece.

5. The apparatus of claim 1 wherein the tool further comprises an end surface for applying electromagnetic pressure to the workpiece.

6. The apparatus of claim 5 wherein the aperture further comprises an aperture wall and wherein the end surface and a portion of the aperture wall disposed closest to the end surface are curved.

7. The apparatus of claim 1 wherein the insulator reinforces the tool to withstand load forces.

8. The apparatus of claim 7 wherein the aperture further comprises an aperture wall, at least a portion of the aperture wall having a serpentine configuration that increases a current flow path through the electrically conductive body and toward a working surface disposed proximate an end of the tool.

9. The apparatus of claim 1 wherein the tool further comprises an end surface and a recess that extends from the aperture toward the end surface.

10. The apparatus of claim 9 wherein the recess extends from the first surface toward the second surface and wherein the insulator at least partially fills the recess.

11. The apparatus of claim 1 wherein the electrically conductive body further comprises an end feature made of a material having higher conductivity than an adjacent portion of the electrically conductive body to facilitate the distribution of pressure for forming the workpiece.

12. An apparatus for electromagnetically forming a workpiece, the apparatus comprising:

a solenoid coil for generating an electromagnetic field; and a tool for concentrating the electromagnetic field provided by the solenoid coil to exert force against the workpiece, the tool including:

an electrically conductive body having a first surface, a second surface disposed opposite the first surface, an aperture extending between the first and second surfaces and having an aperture wall at least a portion of which has a serpentine configuration, and an end surface for applying electromagnetic force to the workpiece; and an insulator disposed in the aperture;

wherein the aperture and the insulator cooperate to increase a current flow path through the electrically conductive body to facilitate electromagnetic forming of the workpiece.

13. The apparatus of claim 12 wherein the aperture is defined by an aperture wall having a serpentine configuration that increases the current flow path through the electrically conductive body and toward a working surface disposed proximate an end of the tool facing the workpiece.

14. The apparatus of claim 12 wherein the tool further comprises a recess extending from the aperture toward the end surface.

15. The apparatus of claim 14 wherein the recess extends from the first surface toward the second surface and wherein the insulator at least partially fills the recess.

16. An apparatus for electromagnetically forming a workpiece, the apparatus comprising:

a multi-turn solenoid coil for generating an electromagnetic force; and a tool disposed proximate the multi-turn solenoid coil for concentrating electromagnetic force provided by the multi-turn solenoid coil against the workpiece, the tool including:

an electrically conductive body having a first surface, a second surface, an aperture extending between the first and second surfaces, and an end portion disposed adjacent to the aperture, the end portion having an exterior surface for applying electromagnetic force to the workpiece, and a recess disposed adjacent to the aperture and extending partially through the electrically conductive body such that the recess is spaced apart from the exterior surface; and an insulator disposed in the aperture, the insulator directing current around the aperture;

wherein the aperture and recess cooperate to increase a current flow path through the electrically conductive body to facilitate electromagnetic forming of the workpiece.

17. The apparatus of claim 16 wherein the aperture is defined by a serpentine aperture wall that extends around the aperture.

18. The apparatus of claim 16 wherein the electromagnetic body further comprises a cavity disposed adjacent to the end surface, the cavity having a generally semicircular shape.

19. The apparatus of claim 18 wherein the aperture includes first and second extension portions spaced apart from the cavity and extending toward the end portion such that the first and second extension portions are disposed on opposite sides of the cavity.

20. The apparatus of claim 16 wherein the insulator reinforces the tool to withstand load forces.

21. An apparatus for electromagnetically forming a workpiece, the apparatus comprising:

a solenoid coil for generating an electromagnetic field; and a tool for concentrating the electromagnetic field to exert pressure against the workpiece, the tool including:

an electrically conductive body having a first surface, a second surface, and an aperture extending between the first and second surfaces; and an insulator disposed in the aperture, the insulator directing current around the aperture to distribute the pressure for forming the workpiece, wherein the insulator structurally reinforces the tool.

* * * * *